United States Patent [19]

Murata et al.

[11] Patent Number: 4,764,139

[45] Date of Patent: Aug. 16, 1988

[54] PRODUCTION METHOD FOR CHANNEL PLATE

[75] Inventors: Michihiro Murata; Hiroshi Yamamoto, both of Kyoto, Japan

[73] Assignee: Murata Manufacturing Co., Ltd., Japan

[21] Appl. No.: 916,826

[22] Filed: Oct. 9, 1986

[30] Foreign Application Priority Data

Oct. 11, 1985 [JP] Japan ..... 60-227095

[51] Int. Cl.[4] ..... H01J 9/12

[52] U.S. Cl. ..... 445/49; 264/61; 264/62; 264/67; 313/105 CM

[58] Field of Search ..... 29/163.5 R; 445/49, 445/50; 313/103 CM, 105 CM; 264/58, 60, 67, 61, 62

[56] References Cited

U.S. PATENT DOCUMENTS

| | | | |
|---|---|---|---|
| 3,375,569 | 4/1968 | Eichinger et al. | 29/163.5 R |
| 3,519,870 | 7/1970 | Jensen | 313/105 CM |
| 3,612,946 | 10/1971 | Toyoda | 313/105 CM |
| 3,790,840 | 2/1974 | Toyoda | 313/105 CM |
| 3,854,186 | 12/1974 | Sergeys | 264/58 X |
| 3,879,626 | 4/1975 | Washington et al. | 313/105 CM |
| 3,923,940 | 12/1975 | Hujii et al. | 264/67 X |

FOREIGN PATENT DOCUMENTS

| | | | |
|---|---|---|---|
| 2709003 | 9/1977 | Fed. Rep. of Germany | 264/60 |
| 2061934 | 6/1971 | France | 29/163.6 |
| 51-1442 | 1/1976 | Japan . | |
| 51-1443 | 1/1976 | Japan . | |
| 54-15045 | 6/1979 | Japan . | |

*Primary Examiner*—Kenneth J. Ramsey

*Attorney, Agent, or Firm*—Ostrolenk, Faber, Gerb & Soffen

[57] ABSTRACT

A method for production of channel plate from sheet material having secondary emission yield after firing. According to the method, a plurality of parallel ribs are formed on the sheet. Then at least two layers of sheet are arranged one over the other by stacking in such manner that each rib element extends in the same direction, or the sheet is rolled into a spiral form which can be cut into channel plates. The stacked or rolled sheet material is then fired so as to adhere the surfaces of the ribs to the surfaces of the adjacent sheet to form the channel plate. In the particular embodiment disclosed herein, the sheet is rolled in the longitudinal direction of the ribs and the spiral body is cut into sector like pieces. After firing, electrodes are formed onto opposed end surfaces including end surfaces of each rib.

2 Claims, 4 Drawing Sheets

PRODUCTION METHOD FOR CHANNEL PLATE

BACKGROUND OF THE INVENTION

1. Field of the Invention

The present invention relates to a production method for a channel plate which is used to multiply charged particles such as electrons and/or ions or photons such as ultraviolet rays.

2. Description of the Prior Art

The channel plate has been used for intensifying the resolution of image which is essentially comprised of a plate member having a plurality of channels passing therethrough.

As is shown in FIG. 7 by way of example, the channel plate has such a structure that circular electrodes 5*a* and 5*b* are formed respectively on each side surface of a disk-like base plate 5 being made of a semi-conductive ceramic material having a secondary electron emission yield and a lot of micro channels 6 are formed so as to pass through said base plate parallel to each other in the direction of thickness thereof. Conventionally, there have been known, as a material for the channel plate, a semi-conductive ceramic material including barium titanate, or zinc titanate as a main component which has a high resistivity and a secondary electron emission yield, an insulative material such as a glass plate on each surface of which a thin film such as a NESA film having a high resistivity and a high secondary electron emission yield and/or a lead glass.

A variety of production methods for the channel plate have been known as follows.

According to one of production methods, nylon fibers are passed through a mass of slurry including powder of a semi-conductive ceramic material to adhere said slurry onto the surface of said fiber. These fibers are wound aligned and, then dried and burned to form channels. However, this method has disadvantages in that processes thereof are very complicated, that it is difficult to form channels in a state aligned regularly and that high skill is required in burning nylon fibers perfectly.

Also, according to the second method, thin plates of about 100 μm in thickness are made by burning plates of a semi-conductive ceramic material. These plates are aligned to have an equidistance of about 100 μm between adjacent plates and assembled into a block by fixing both sides thereof.

However, according to this method, it is very difficult to assemble these thin plates exactly and, also, it is difficult to fabricate the device for assembling. Further, according to this method, it is hardly possible to obtain a structure having a two dimensional arrangement of channels.

According to one method which uses glass material as a base plate, several or several tens of glass tubes are bundled and made into a block by melting to each other while pressing and heating them. The block obtained is heated up near the softening point of said glass and then, lengthened to a fine tube. After repeating these processes several times, a block is formed which has capillary-like through holes of diameter less than 100 μm. Then, several blocks thus obtained are inserted into a mold integrally and melted into one piece while pressing and heating.

However, according to this method, it becomes necessary to repeat complex processes and the cost of the channel plate becomes very high due to a large number of producing steps.

In the case that lead glass is used to make a channel plate, the method thereof is essentially same to that mentioned just above, but different from the latter only in a point that lead metal is made depositted on the surface by heating said block in an ambient gas of hydrogen up to, for instance, 400° C. Accordingly, this method has disadvantages similar to those of the second method mentioned above.

As is understood from the above mentioned, any of conventional method for producing channel plate has many restrictions in many points and requires high skills upon the production thereof.

SUMMARY OF THE INVENTION

One essential object of the present invention is to provide a method for producing channel plates easily.

According to the present invention, there is provided a production method for channel plate comprising following steps;

a step for forming sheet element using a secondary electron emissive material, a step for forming linear ribs on the surface of said sheet element parallel to each other and at an equal pitch each of which has almost constant width, a step for stacking at least two said sheet elements one on the other in such a manner that every sheet is directed to a same direction, a step for burning the stacked body so as to adhere surfaces of said ribs of one sheet element to the flat surface of the adjacent sheet element by heating and, a step for forming electrodes on both end surfaces of said stacked body including end surfaces of each linear rib.

According to the present invention, semi-conductive ceramic materials having high secondary electron emission yield are desirably used as a material for making sheets.

These sheet elements may be made according to a forming method such as a doctor-blade method or the like.

Linear ribs may be formed on each sheet element, for instance, by the method of screen-print or the like.

According to the present invention, since the thickness of the sheet element, the height of the linear rib, the width and the pitch thereof can be easily varied, dimensions and distribution of channels can be altered according the specification of the channel plate desired.

According to another method based on the present invention, one sheet element, after forming ribs thereon, is wound spirally so as to contact surfaces of ribs with the flat surface of the sheet element. This wound sheet element is dried and adhered by heating to form a base channel plate.

The winding axis can be chosen so as to have a direction parallel to the longitudinal direction of each rib or a direction perpendicular to the longitudinal direction of each rib.

If the former is chosen, the wound block its self can be used as a base channel plate. In this case, electrodes are formed on each circular end face of the wound block.

If the latter is chosen, the wound block is cut into one or more sector blocks and electrodes are formed on each cut off end face thereof.

BRIEF DESCRIPTION OF THE DRAWINGS

The present invention will now be described more in detail by way of examples with reference to the accompanying drawings in which.

Figure 1A:
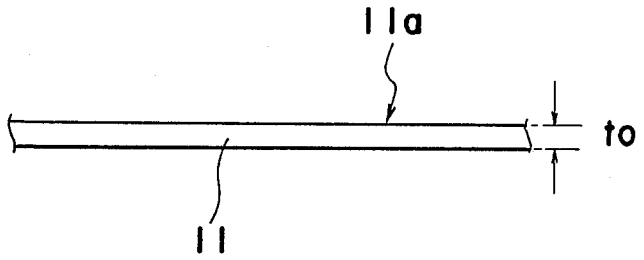
FIGS. 1(*a*), 1(*b*) and 1(*c*) are explanatory views showing steps for forming a stacked sheet body according to the present invention.
Figure 1B:
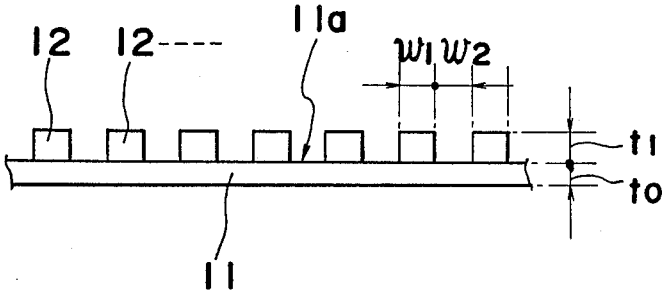
Figure 1C:
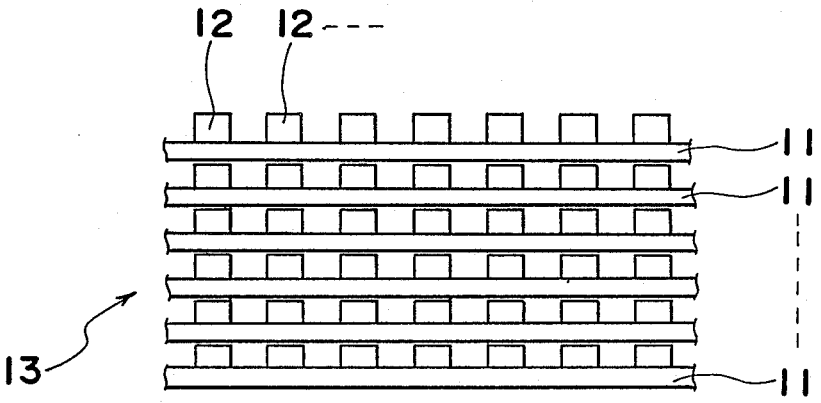

As is shown is FIG. 1(*a*), a thin green sheet 11 of a thickness, for example, of 20 μm is made from slurry obtained by mixing powder of a semi-conductive ceramic material such as zinc titanate with suitable binder, which has a secondary electron emission yield. So called pushing out molding method and/or doctor-blade method are desirably used for forming said green sheet.

As shown in FIG. 1(*b*), on the one surface 11*a* of the sheet 11, many linear ribs 12 are formed in the direction of width of the sheet with use of screen-printing method or the like. The material of the linear rib 12 is desirably selected to the same material as of the sheet.

In the present embodiment, the linear rib is formed to have sectional dimensions of a height t1=20 μm, width w1=20 μm and these ribs are aligned with an equal pitch w2 of 20 μm.

After linear ribs have been formed on the upper surface of each sheet 11, these green sheets are stacked one by one aligning each sheet so as to have a uniform direction. Thus, as shown in FIG. 1(*c*), a stacked body 13 is formed.

This stacked body 13 thus obtained is dried properly and then put into a suitable furnace (not shown) in order to heat or burn it.

Due to this heat treatment, the upper surfaces of the linear ribs are adhered to the lower surface of the upper sheet stacked thereon and, therefore, a tight ceramic block is obtained which has a fine lattice-like cross-section.

The ceramic block thus obtained is cut out into pieces in the plane perpendicular to the direction of each linear rib 12.

Figure 2:
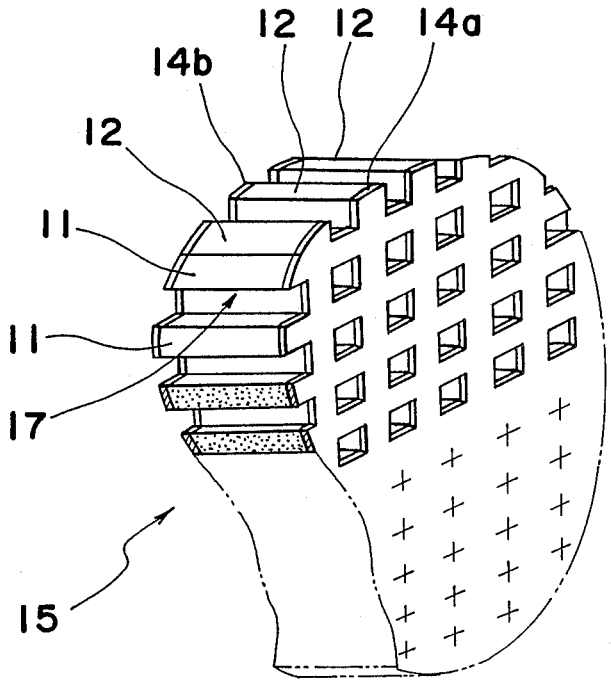
FIG. 2 is a perspective view of the channel plate partially cut off, which is obtained according to the present invention.

As shown in FIG. 2, on each end surface of the piece 17 thus obtained, there is formed an electrode 14*a* or 14*b*.

Due to these process, a channel plate 15 having a plenty of channels 17 arranged regularly and lattice like is easily obtained. Each channel 17 serves to emit secondary electrons when one or more charged particles or photons are entered thereinto from one end thereof provided that a suitable voltage is applied between said two electrodes 14*a* and 14*b*.

It is to be noted that the dimensions of each channel 17 and the density or distribution of these channels can be chosen arbitrarily by changing the thickness t0 of the sheet 11, the height t1, width w1 and/or pitch w2 of the linear rib 12.

Figure 3:
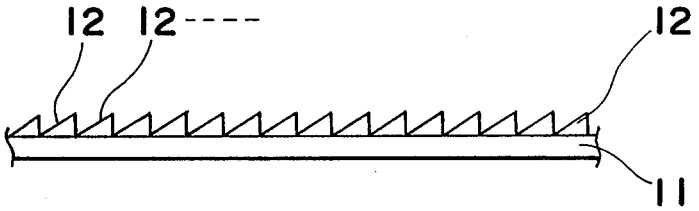
FIG. 3 is a schematical sectional view for showing a variation of rib.

Further, as shown in FIG. 3, the rib 12 can have a triangular cross-section, or a half circular (not shown) cross section.

Figure 4:
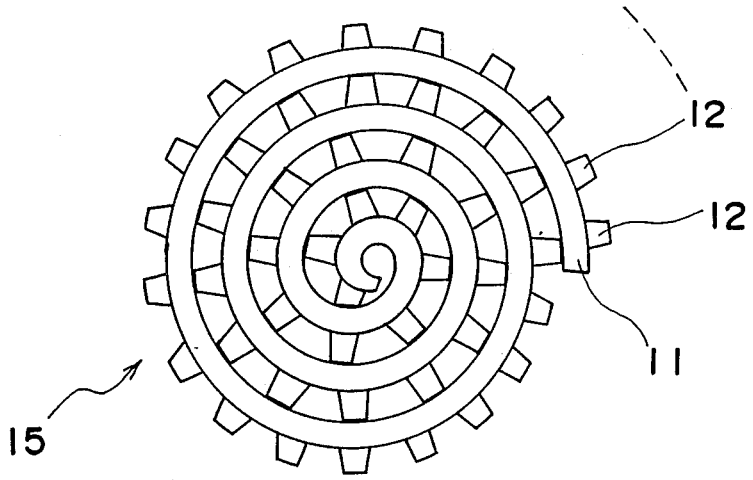
FIG. 4 is a front view showing another preferred embodiment of the present invention.

FIG. 4 shows another method for forming a channel plate.

In this method, one sheet 11, after forming linear ribs 17, is wound spirally around an axis having a direction same to the longitudinal direction of the linear rib. According to this method, a channel plate member 15 is directly obtained without necessity of cutting the block.

Figure 5:
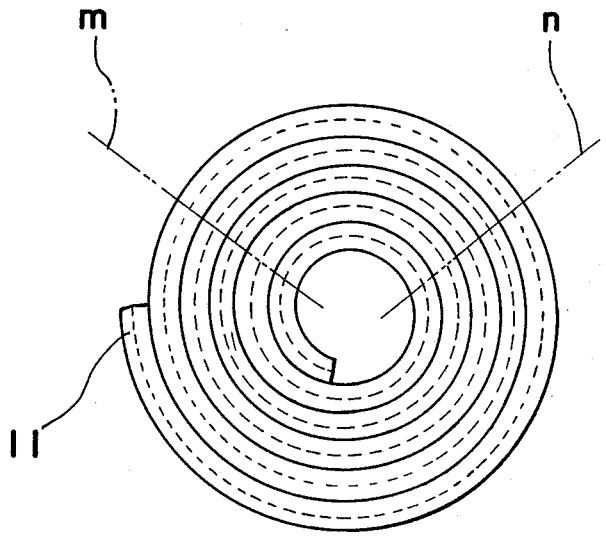
FIGS. 5 and 6 are explanatory views showing other preferred embodiments of the present invention respectively.
Figure 6:
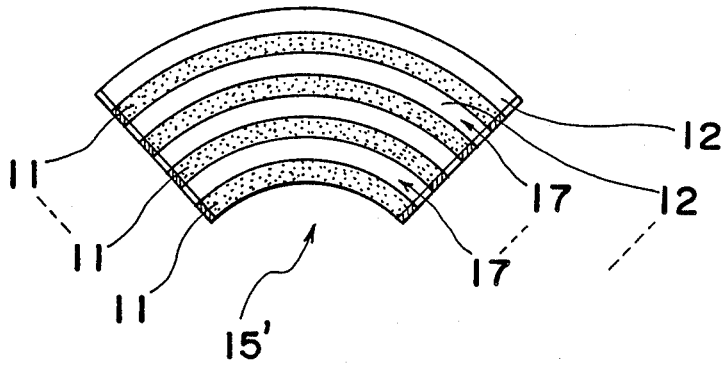
Figure 7:
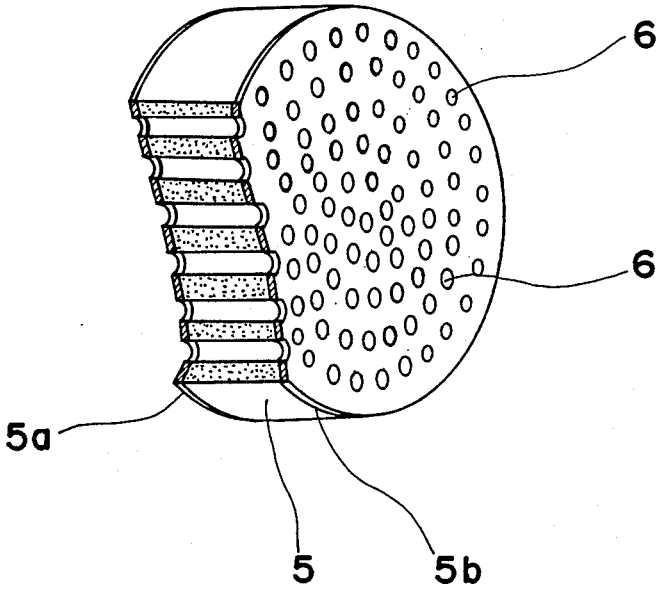
FIG. 7 is a perspective view of a conventional channel plate partially cut off.

FIG. 5 and FIG. 6 show one more method according to the present invention.

In this method, as shown in FIG. 5, one sheet 11, after forming linear ribs 17, is wound spirally around an axis having a direction orthogonal to the longitudinal direction of the linear rib 17.

After heating it, it is cut off along the planes m and n.

According to this method, as shown in FIG. 6, a channel plate 15' having curved arc-like channels 17 can be obtained easily.

The channel plate 15' of this type has a stable property in its operation since ion-feed back is reduced considerably.

It is also possible to wind the stacked sheet as shown in FIG. 1(*c*) spirally.

While there has been described the preferred embodiments, modifications and variations being obious to those skilled in the art are possible without departing from the spirit of the invention. The scope is therefore to be determined solely by the appended claims.

What is claimed is:

1. A production method for a channel plate comprising the following steps:

forming a sheet element having first and second surfaces using a material having a secondary electron emission yield, forming linear ribs on the first surface of said sheet element which are parallel to each other and at an equal pitch, each of said ribs having substantially constant width, at least one sheet element spirally to form a wound body, after forming said ribs thereon, so as to contact outer surfaces of the ribs with the flat second surface of the sheet element, in which said wound body is formed by winding the sheet element around an axis substantially perpendicular to the longitudinal direction of the ribs;

burning or heating the wound body thus formed so as to adhere said outer surfaces of the ribs on the sheet element to the flat second surface thereof, and forming electrodes on both end surfaces of a block formed from at least a part of the wound body including end surfaces of each linear rib.

2. A production method according to claim 1, in which said body is cut into sector like pieces.

* * * * *